US011291257B2

(12) United States Patent
Epp Frenette

(10) Patent No.: US 11,291,257 B2
(45) Date of Patent: Apr. 5, 2022

(54) APPAREL WITH INTEGRATED STORAGE

(71) Applicant: Kim Epp Frenette, Waxhaw, NC (US)

(72) Inventor: Kim Epp Frenette, Waxhaw, NC (US)

( * ) Notice: Subject to any disclaimer, the term of this patent is extended or adjusted under 35 U.S.C. 154(b) by 0 days.

(21) Appl. No.: 15/841,068

(22) Filed: Dec. 13, 2017

(65) Prior Publication Data

US 2018/0160751 A1 Jun. 14, 2018

Related U.S. Application Data

(60) Provisional application No. 62/433,763, filed on Dec. 13, 2016.

(51) Int. Cl.

| | |
|---|---|
| ***A41D 27/20*** | (2006.01) |
| ***A41D 27/24*** | (2006.01) |
| ***A45F 5/02*** | (2006.01) |
| *A41D 3/00* | (2006.01) |
| *A41B 1/08* | (2006.01) |
| *A41D 1/06* | (2006.01) |
| *A41D 1/14* | (2006.01) |

(52) U.S. Cl.

CPC ..... *A41D 27/20* (2013.01); *A41D 27/201* (2013.01); *A41D 27/205* (2013.01); *A41D 27/208* (2013.01); *A41D 27/24* (2013.01); *A45F 5/02* (2013.01); *A45F 5/022* (2013.01); *A41B 1/08* (2013.01); *A41D 1/06* (2013.01); *A41D 1/14* (2013.01); *A41D 3/00* (2013.01); *A41D 2300/322* (2013.01); *A45F 2200/0541* (2013.01); *A45F 2200/0558* (2013.01)

(58) Field of Classification Search

CPC .... A41D 27/20; A41D 27/201; A41D 27/205; A41D 27/208; A41D 27/24

See application file for complete search history.

(56) References Cited

U.S. PATENT DOCUMENTS

| | | | | |
|---|---|---|---|---|
| 8,127,701 | B2 * | 3/2012 | Harward | A41D 27/24 112/475.17 |
| 8,509,470 | B2 * | 8/2013 | Lee | A41D 1/005 381/333 |
| 8,898,816 | B2 * | 12/2014 | Highfield | A41D 1/002 2/247 |
| 9,362,618 | B2 * | 6/2016 | Alberth, Jr | H01Q 1/245 |
| 9,968,141 | B2 * | 5/2018 | Ward | G01N 1/2273 |
| 10,134,495 | B2 * | 11/2018 | Easley | G21F 3/02 |
| 10,178,815 | B1 * | 1/2019 | Vieyra | H05K 9/0007 |

* cited by examiner

*Primary Examiner* — Khaled Annis

(74) *Attorney, Agent, or Firm* — Michael G. Monyok

(57) ABSTRACT

Embodiments disclosed herein describe an apparel item that integrates a plurality of storage pockets. In one embodiment, the storage pockets are staggered and arranged to secure items close to the body of the wearer, minimizing the bulk created by the stored items. Further, the openings of the pockets are constructed to allow easy access to the stored items, while still providing secure stowage of the stored item.

15 Claims, 8 Drawing Sheets

APPAREL WITH INTEGRATED STORAGE

CROSS-REFERENCE TO RELATED APPLICATIONS

This application claims the benefit under 35 U.S.C. § 119 of Provisional Application Ser. No. 62/433,763, filed Dec. 13, 2016, which is incorporated herein by reference.

STATEMENT REGARDING FEDERALLY SPONSORED RESEARCH

Not applicable.

BACKGROUND OF THE INVENTION

The invention relates generally to apparel items. More specifically, the invention relates to apparel items with integrated storage solutions, allowing a wearer to carry a variety of items without the bulk of bags, purses, or backpacks and without the limited capacity and disorganization of pockets found in traditional apparel items.

People often carry a multitude of items with them in bags, backpacks, purses, or even pockets. Items such as a cellular phone, passport, keys, lipstick, credit cards and identity cards, boarding passes, money, writing instruments, and sunglasses, are just a few examples of items that people carry with them when running errands or traveling. While backpacks and other storage solutions offer ample storage, they are often disorganized and can become lost, stolen, or misplaced. Similarly, pockets in traditional garments do not offer efficient or organized storage solutions as many items are often stored in a single pocket. In many instances, a wearer will empty all of the items from their pockets in order to find one particular item. It would therefore be advantageous to develop an apparel item that provides secure storage for a variety of items without the bulk or other drawbacks of bags, purses, or pockets in traditional garments.

BRIEF SUMMARY

According to embodiments of the present invention is an apparel item, such as a top or shirt, having integrated storage pockets. In one example embodiment, the apparel item comprises a pocket panel with a multitude of pockets that is affixed to the garment, such as a shirt.

DETAILED DESCRIPTION

Figure 1:
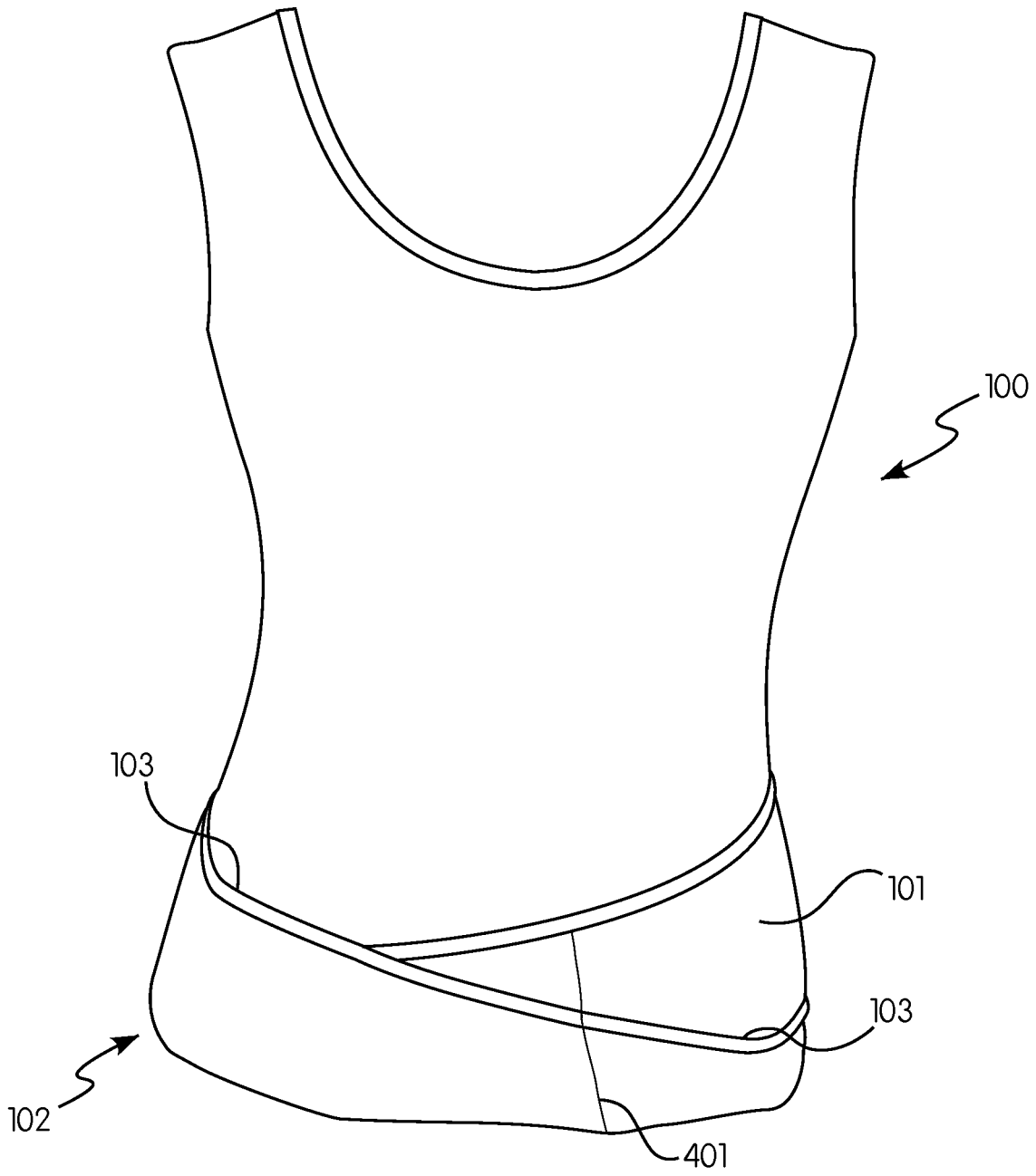
FIG. 1 shows an apparel item with a pair of multi-pocket panels at the bottom of the garment, according to one embodiment.

Described herein is an apparel item 100 having a plurality of integrated storage pockets 101. In one embodiment, the apparel item 100 comprises a multi-pocket panel 102 positioned at the bottom of the garment 100 and affixed to an exterior surface of the apparel item 100. As shown in FIG. 1, two pocket panels 102 are affixed to the bottom of the shirt, where a first pocket panel 102 overlaps a second pocket panel 102, with the openings 103 for each pocket 101 of the pocket panels 102 directly accessible. The pocket panels 102 span the front of the garment from hip to hip, below the natural waistline. In this embodiment, each multi-pocket panel 102 comprises three pockets 101, for a total of six pockets 101. In this particular embodiment, some of the pockets 101 may include zippers for items requiring more secure storage, such as credit cards.

Referring again to the embodiment depicted in FIG. 1, each of the lower pocket panels 102 are designed with sloped pocket openings 103, which allows access from a top edge of each pocket 101. The angle of the openings 103 aids access by the wearer, but also can be specified for aesthetic reasons. For example, in the embodiment shown in FIG. 1, the height, slope, and pocket ratios are determined so as to give the wearer an appearance of a slimmer waist, while also considering the size of pockets 101 suitable for the most common items carried by the wearer. As a person having skill in the art will appreciate, the height, slope, size, orientation, and other physical characteristics of the pockets 101 can be adjusted based on the intended use, size of the garment, and aesthetic design parameters. For example, a pocket 101 with a zipper may have an opening 103 near its side, rather than at the top edge.

For the example shown in FIG. 1, the top 100 can be worn on its own or as an undergarment, providing a wearer with discrete, secure, and accessible storage for personal items even underneath many styles of tee-shirts, blouses, sweaters, jackets, and other garments. In this particular embodiment, the garment 100 is constructed from body-hugging stretch fabric. However, in alternative embodiments, other fabrics suitable for garment construction are used.

Figure 2:
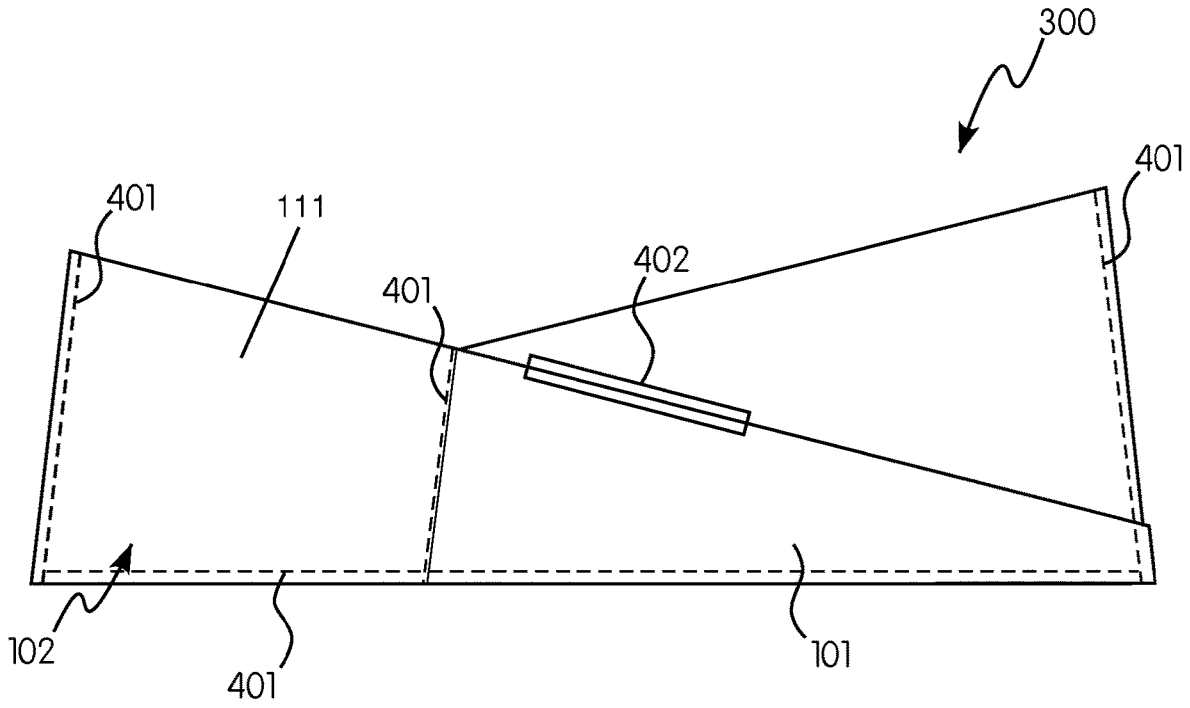
FIG. 2 is mock-up of the multi-pocket panel, which can be used in construction and design of the apparel item.

FIG. 2 depicts a mock-up 300 of the pocket panels 102 incorporated into the shirt 100 shown in FIG. 1. As shown in FIG. 2, the pocket panels 102 comprise two overlapping double layers of fabric in a triangle shape. That is, each pocket panel 102 comprises a fully contained interior compartment 111, creating a discrete pocket 101 in each panel 102. That is, the first triangle creates an interior pocket panel 102 and the second triangle creates an exterior pocket panel 102, where the interior and exterior pocket panels 102 overlap. Seams 401 can be sewn into one or both fabric pocket panels 102 to create additional compartments or pockets 101. In one embodiment, a zipper is added along the top perimeter of the pocket panel 102 that faces the shirt fabric, creating a zippered pocket 101 hidden inside of the pocket panel 102. FIG. 2 further shows markings for the location of seams 401 (internal seams shown by dashed 1 lines), zippers 402, and other structural components of the pocket panel 102. For example, an additional zipper 402 is added to the front of the pocket panel 102 at the location where the two fabric panels 102 overlap, creating a closed center pocket 101 in the fold between the two.

To attach the pocket panel 102 to the shirt, both lateral edges of the pocket panel 102 are sewn into the side seam of the shirt 100. A third seam 401 is created along the bottom of the pocket panel to close the bottom of the panel 102. In one embodiment, the pocket panel 102 is incorporated into the garment 100 during construction of the garment 100. However, in an alternative embodiment, the pocket panel 102 can be added to an existing garment 100. In either embodiment, the pocket panel 102 can be made of matching or non-matching fabric. As shown in the panel mock-up 300 depicted in FIG. 2, vertical seams 401 can be sewn into the panel 102 to create additional compartments or pockets 101 within the pocket panel 102. For example, two vertical seams 401 will divide a single pocket 101 into three smaller pockets 101. In one embodiment, a vertical seam is sewn into the shirt and pocket panel approximately 5.75 inches from the cross-point seam (i.e. where the two triangles intersect).

Figure 3:
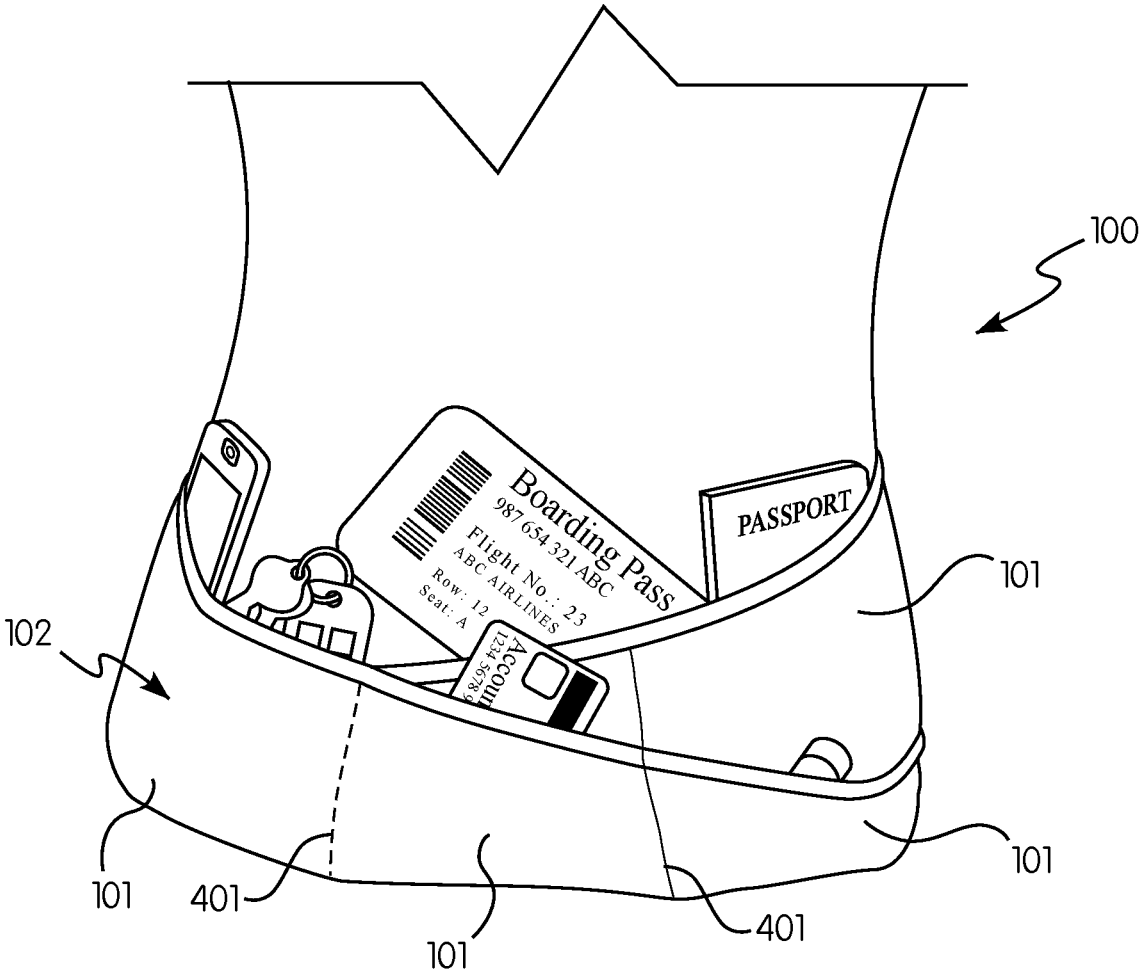
FIG. 3 shown an apparel item according to one embodiment, showing various items partially stowed in the storage pockets of the multi-pocket panel.

Referring again the drawings, FIG. 3 shows the pocket panels 102 with six pockets 101 of varying size, shape, and security. Several items are partially placed in the pockets 101 to show the location of the pocket 101 and the types of items that can be stored in the pockets 101. Once fully stowed in the pockets 101, the items cannot be seen and the bulk is minimized as the items are organized into separate pockets 101.

In one specific example, a medium sized shirt can include a pair of bottom pocket panels 102 with a width of 19 inches. The height of the panels 102 is approximately 6.75 inches on the higher side and 5.5 inches on the lower side, or approximately 80% of the higher pocket 101. A cross-point seam 401 is located approximately 2.875 inches from the centerline of the garment 100, allowing for a center zippered pocket 100 of about 5.75 inches. As a result, the cross-point seam 401 appears to divide the garment into ⅓ and ⅔ horizontal sections. The obtuse angle at the cross point created by the crossing top lines of the panels 102 is approximately 150 degrees. The size and dimensions of the preceding embodiment are provides as examples; alternative embodiments can have varying dimensions based on the size of the garment, storage needs, and design considerations.

Figure 5:
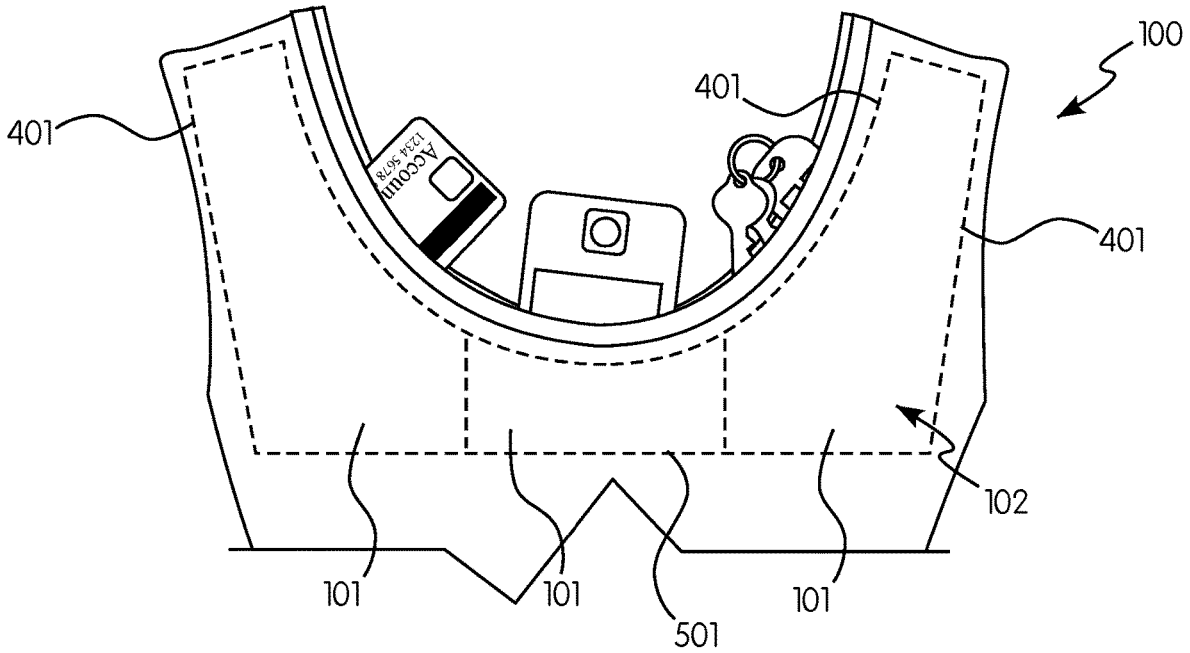
FIG. 5 shows items partially stored in the chest pocket panel of an apparel item, according to one embodiment.

In an alternative embodiment depicted in FIG. 5, an integrated pocket panel 102 is incorporated into the neckline of the garment 100. In the example shown in FIG. 5, a chest area pocket panel 102 incorporates three pockets 101 accessed from the neckline of the garment 100, so that items can be discretely stored and retrieved. In another embodiment, the pockets 100 along the neckline are accessed over protruding fabric so it is apparent to others that the user is not reaching under the shirt fabric and/or touching their skin to access the items.

As shown in FIG. 3 and FIG. 5, the apparel item 100 allows a wearer to carry items that would normally be carried in a small purse, handbag, small backpack, or belt bag. Moreover, the apparel item 100 enables the wearer to carry the items physically close to their body, providing a discrete and secure means of carrying these items. As will be further discussed, the apparel item 100 also enables easy access to the items due to the location of the pockets 101 on the garment 100, the angle of the pockets 101, the construction of the openings 103 of the pockets 101, and placement of zippers 402 or other closure mechanisms, such as velcro or elactic, for example. The construction of both the chest area pocket panel 102 and the bottom pocket panel 102 is such that the appearance of bulkiness is minimized even when items are in the pockets 101.

Referring again to the embodiment depicted in FIG. 5, additional pockets 101 of various constructions are incorporated into the chest area of the garment 100. In this embodiment, two pieces of fabric are joined together to create a pocket panel 102. Seams 401 can be added to the pocket panel 102 to create discrete pockets 101 within the panel 102. For example, two seams 401 in the panel create three separate pockets 101. In the embodiment shown in FIG. 5, the pocket panel 102 comprises three pockets 101, with one approximately covering the left pectoral area, one the right pectoral, and one in the center of the chest over the sternum. The pocket panel 102 is attached to the garment 100 at the side seams 401, front arm holes, and along the neck seam 401. In one embodiment, the pocket panel 102 is not attached along its bottom edge 501 to the front garment at the center chest pocket 101, thereby creating a free-hanging center pocket 101 and two side pockets 101 that stretch across the pectoral area.

In this embodiment, the free-handing pocket permits the cavity between female breasts to be more effectively used as storage space. The free form nature of the pocket 101 permits use of the cleavage area regardless of the cavity size and shape, and permits the capacity of the pocket 101 to vary with the cleavage cavity, which is unique to each wearer. Further, the fabric provides a two way protective barrier between stored items and the skin. The hanging center pocket 101 also permits items stored within to be less visible than in a fixed pocket 101.

Figure 4:
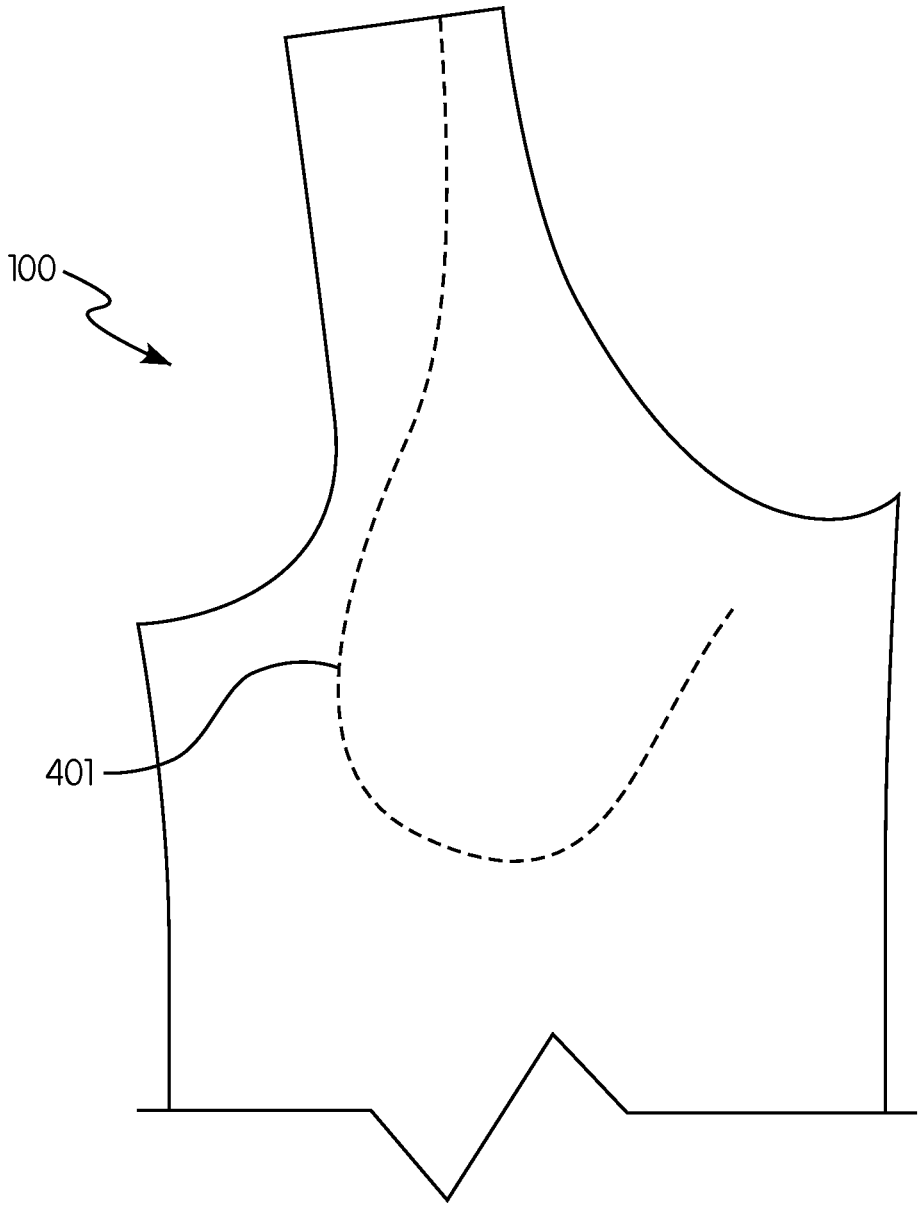
FIG. 4 is a mock-up of a chest area pocket ensemble, according to one embodiment.

In one example embodiment, the pockets 101 are several inches in height and width and can be used to carry a small cell phone or standard size credit cards. In the embodiment shown in FIG. 5, the pockets 101 are accessed from the neckline of the garment 100 by reaching over a second neckline constructed into the garment 100. The second neckline allows a wearer to access the items without reaching under the shirt. FIG. 4 is a mock-up 300 of a portion of the chest area pocket panel 102, showing the relative size and location of a side pocket 101 for one particular garment 100.

Figure 8A:
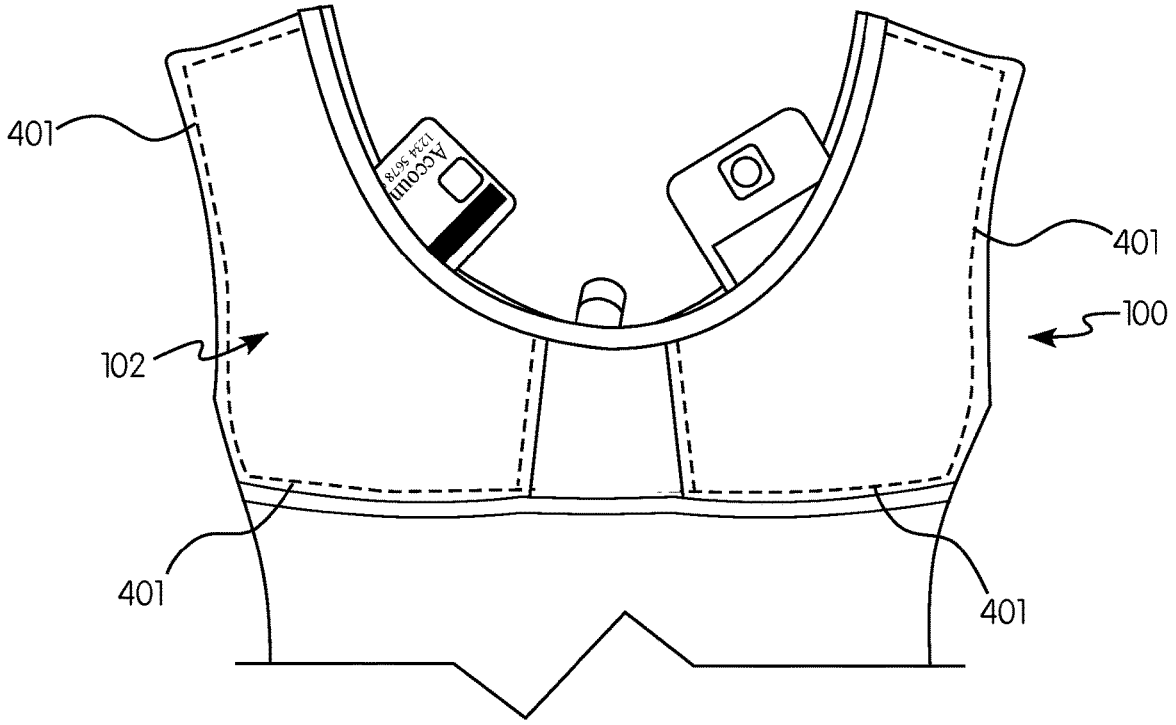
FIGS. 8A-8C show an apparel item according to yet another alternative embodiment.
Figure 8B:
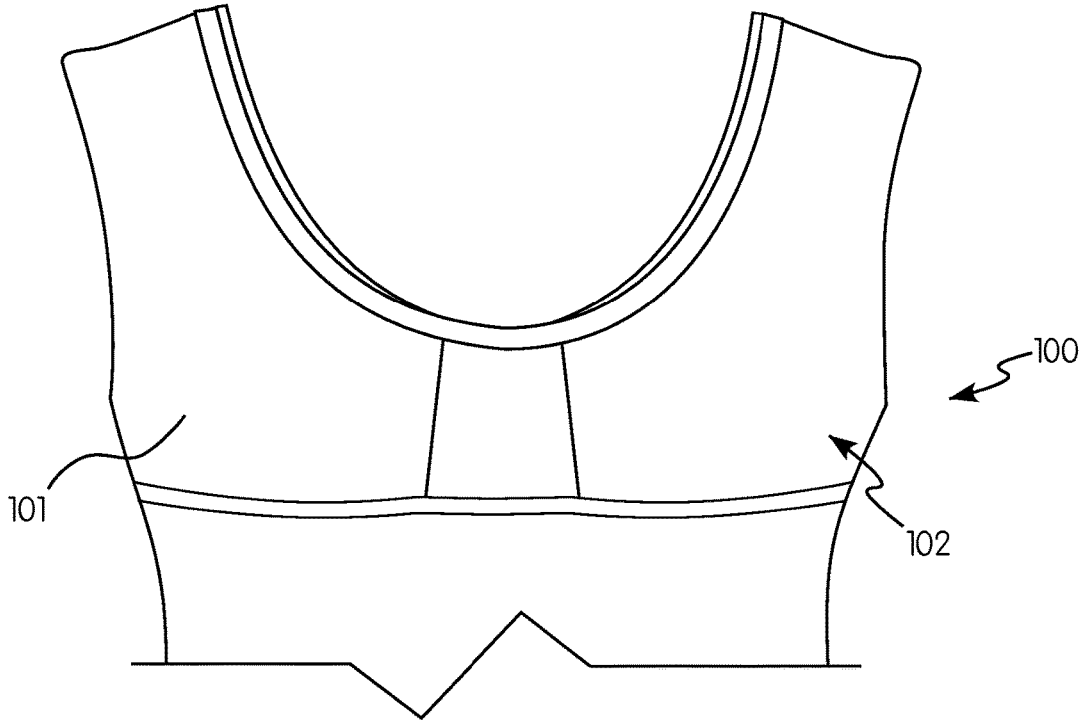
Figure 8C:
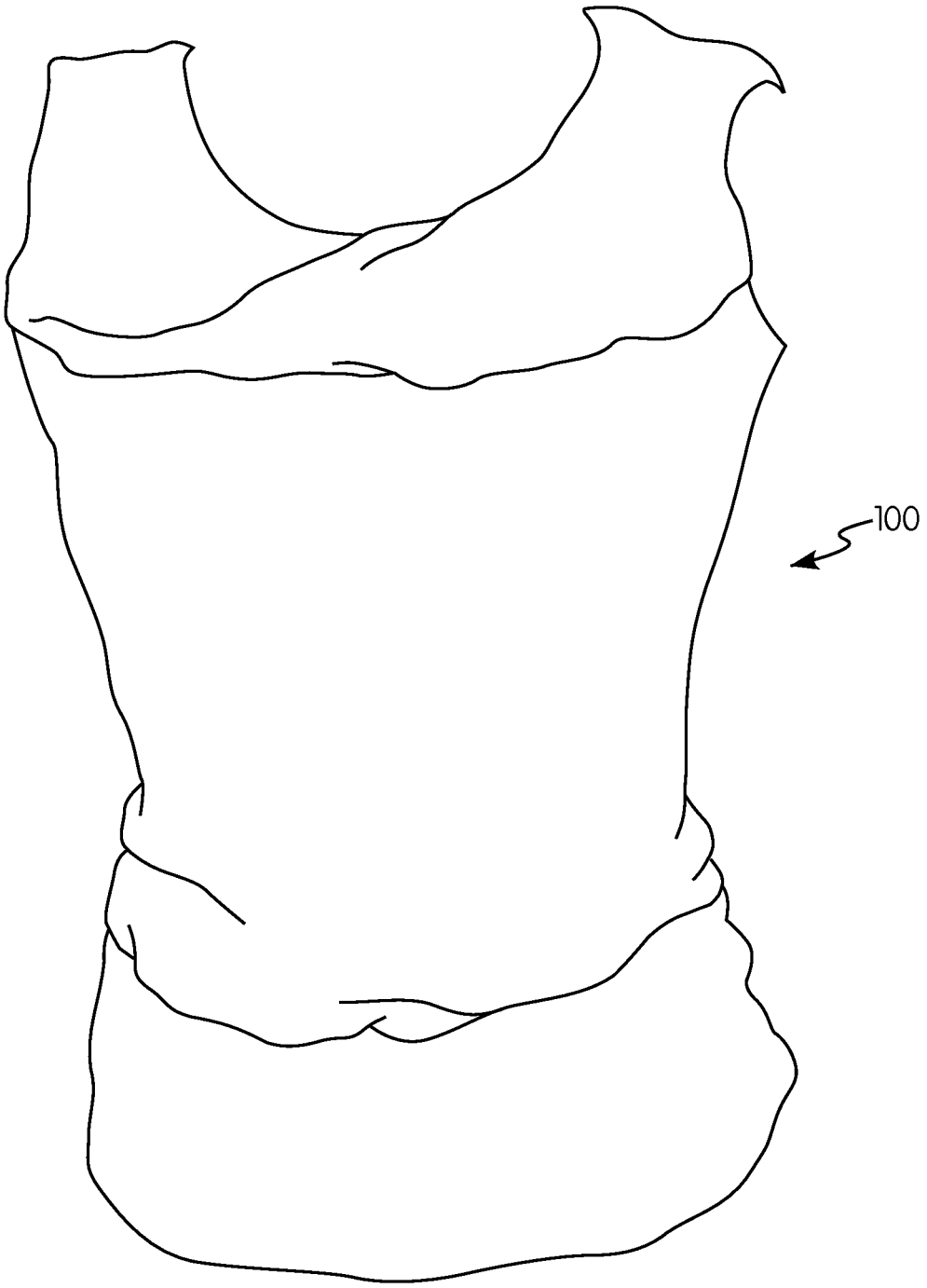

FIGS. 8A-8C shows an alternative embodiment of the chest area pocket panel 102. In this embodiment, the upper pocket area is constructed with a combined fixed pocket/hanging pocket assembly consisting of a fabric piece doubling the exterior front fabric of the garment 100, across the upper chest area, from underarm to underarm and up to the neckline. Starting from the side seam approximately 2 inches below the arm hole on either side, this panel 102 is stitched across the breast line to a point on the neckline approximately 1.5 inches to either side of the chest center. This forms a fixed pocket 101, attached directly to the garment 100, across each pectoral area. Alternatively, an extra piece of fabric is added to the center pocket 100 internally, creating a pouch or hanging pocket 100 that can be placed in the cleavage cavity of the wearer.

In yet another alternative embodiment of the chest area pocket ensemble, the upper pocket panel 102 is constructed with a fixed pocket 101 consisting of a fabric piece doubling the upper chest area, on the inside, from underarm to underarm and up to neckline. Stitching upwards from the cross chest line to the neckline can create additional pockets 101, such as the pocket panel 102 shown in FIG. 8B. FIG. 8C shows an alternative embodiment where the addition of a cowl neckline hides the pocket openings 103.

In any of the embodiments described, the apparel item 100 can include additional features such as waterproof pockets, RFID blocking pockets, and EMI/RF blocking pockets. For example, one or more of the pockets 101 in the lower pocket panel 102 can be transformed into a water proof pocket 101 by the use of canvas oil cloth, thin vinyl material, or other waterproof fabric. In this example, the waterproof pocket can be made by the inclusion of a waterproof pouch inside the interior zippered pocket.

The use of RF blocking fabric in one or more of the pockets would provide added security for credit cards and passports that use radio-frequency identification (RFID). This could prevent the unauthorized reading of cards and/or passports placed in said pocket or pockets.

Additionally, RF blocking fabric could be used in one or more pockets to provide protection for people with EMI/RF sensitivity and those concerned about the potential harm from cell phone radiation. Various types of fabrics known in the art can be used for RF blocking.

While the disclosure has been described in reference to a shirt, the features described can be incorporated into garments used for beachwear, extreme adventure, high-tech travel, high security, and a safe cell top. In addition, the garment can be modified to accommodate fashion and seasonal needs of the wearer while maintaining its essential purpose, that is, to carry personal items physically close to, securely, and discreetly on the body of the wearer while maintaining accessibility. These modifications include, but are not limited to garments with short, ¾ length, bell, cap, and long sleeves; variations of fit options such as larger bust area or curvy hip allowance; skirts, pants, shorts, skorts, coat, and dresses; various necklines, such as cowl, turtle, mock turtle, v-neck and low scoop; and additional fabric and other embellishments to make the stored items and lower pockets less visible.

Figure 6:
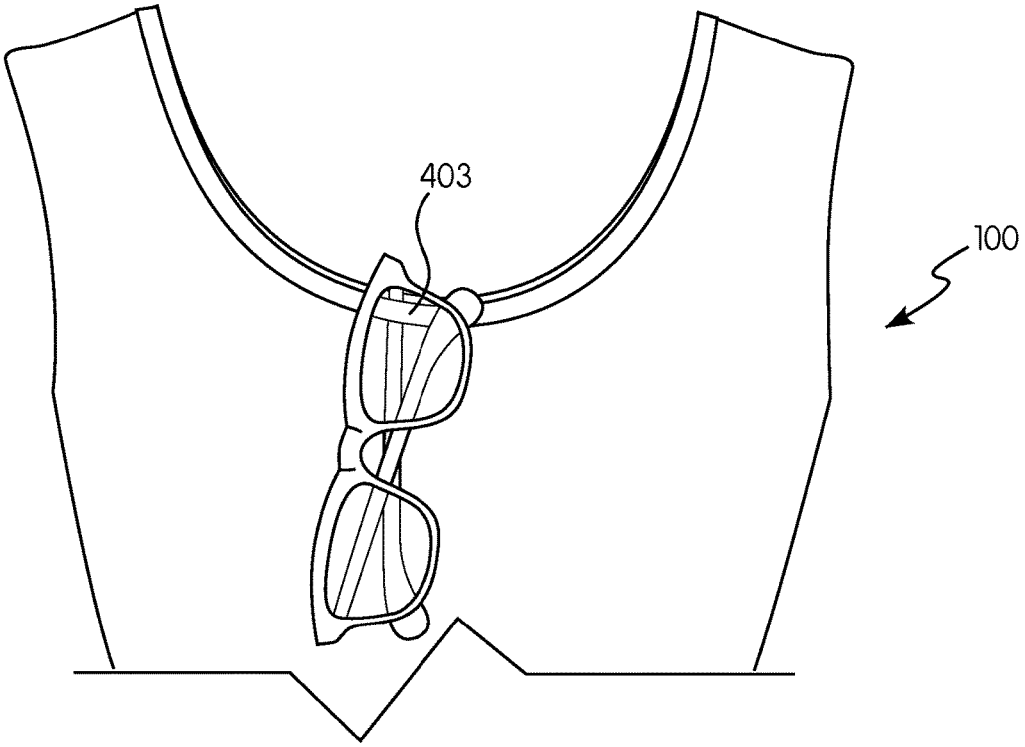
FIG. 6 shows an alternative embodiment comprising a glasses clip.

In an alternative embodiment shown in FIG. 6, the garment further includes a glasses strap 403, which comprises a loop of cording, such as a stretch cord, sewn into the back neckline of the center chest area pocket 100. In one embodiment, a bead can be further provided on the loop, which can be slid towards the stem of glasses placed through the loop. Sliding the bead helps secure the glasses. When not in use, the strap can be tucked inside the pocket. The specialized clasp can also function as a pull cord to enhance ease of use of the center top pocket.

Figure 7:
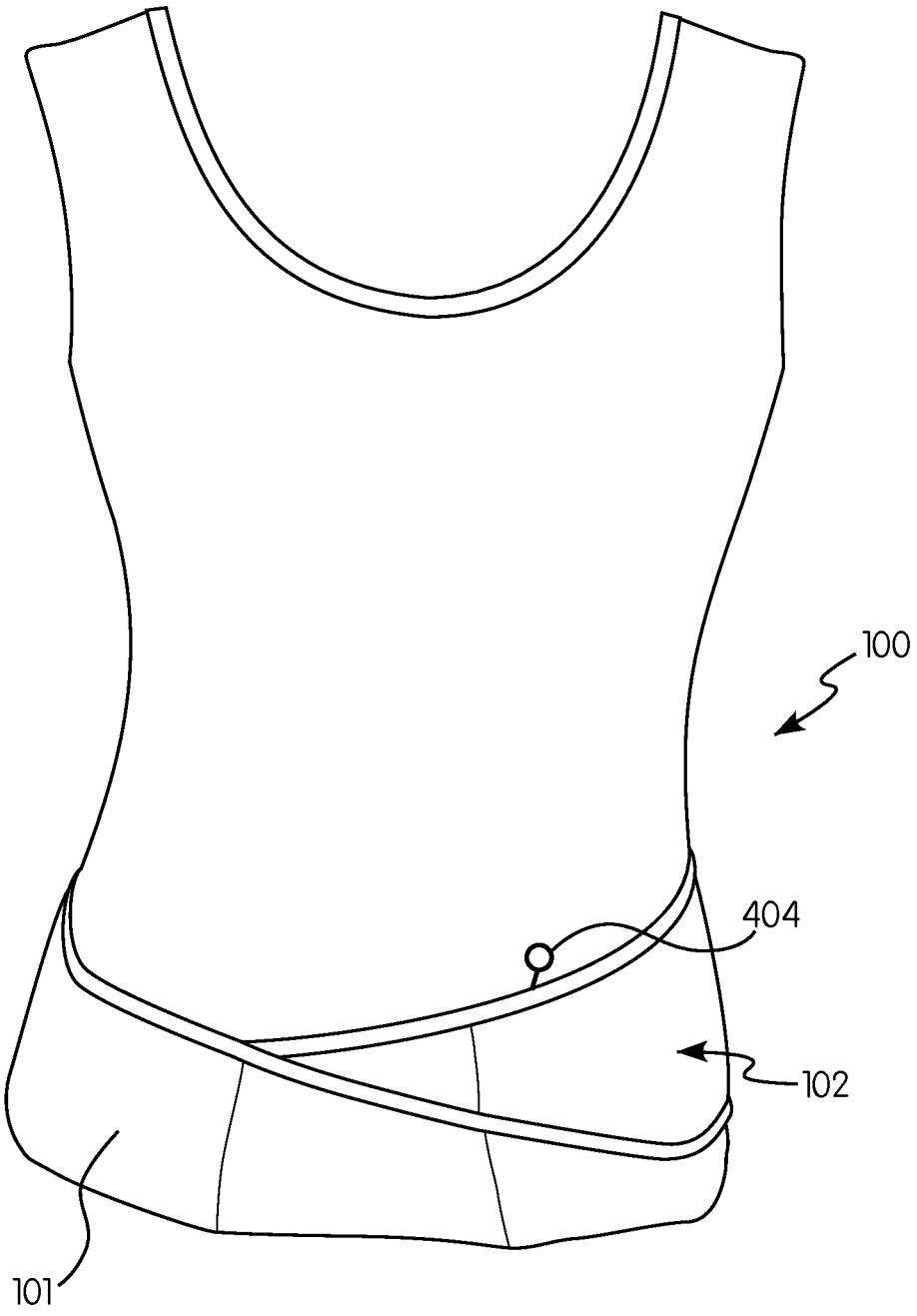
FIG. 7 shows an apparel item according to an alternative embodiment.

Additionally, the garment 100 can further include a wallet and/or key latch 404 (as shown in FIG. 7), which comprises a loop of cording, such as a stretch cord, sewn into the side seam between the back of the lower pocket panel 102 and the front of the garment 100, to which is attached a fastening mechanism such as a lobster claw clasp or other fastener. Keys, wallet or other items can be attached to this latch 404 for extra security while in the pocket and can be pulled out still attached to the extendable cord for access. Similar extendable clasps of varying cord length could be added to seams inside any of the bottom or top pockets for similar fastening purposes.

While the disclosure has been described in detail and with reference to specific embodiments thereof, it will be apparent to one skilled in the art that various changes and modification can be made therein without departing from the spirit and scope of the embodiments. Thus, it is intended that the present disclosure cover the modifications and variations of this disclosure provided they come within the scope of the appended claims and their equivalents.

What is claimed is:

1. An apparel item with integrated storage comprising:
an apparel item having a surface;
a first pocket panel affixed to the surface of the apparel item, wherein the first pocket panel comprises:
a plurality of interior compartments each having an opening to form a plurality of pockets, and
a seam separating adjacent pockets of the plurality of pockets; and
a second pocket panel affixed to the apparel item, wherein the second pocket panel overlaps the first pocket panel.

2. The apparel item of claim 1, wherein the first pocket panel is triangular-shaped and extends from a first side seam of the apparel item to a second side seam of the apparel item.

3. The apparel item of claim 1, wherein a lateral edge of the first pocket panel is integrated with a side seam of the garment.

4. The apparel item of claim 1, further comprising a zipper affixed between the first pocket panel and the second pocket panel, thereby creating an additional pocket between the first pocket panel and the second pocket panel.

5. The apparel item of claim 1, wherein the apparel item is selected from the group consisting of a shirt, pants, skirt, dress, and coat.

6. The apparel item of claim 1, wherein the apparel item is a shirt and the first pocket panel is affixed to an exterior of the surface near a bottom of the shirt.

7. The apparel item of claim 1, further comprising a cross-point seam at the intersection of the first pocket panel and the second pocket panel.

8. The apparel item of claim 1, wherein at least one of the plurality of pockets is constructed of a fabric that prevents the ingress of water.

9. The apparel item of claim 1, wherein at least one of the plurality of pockets is constructed of a fabric that prevents the ingress of EMI/RF radiation.

10. The apparel item of claim 1, further comprising a latch used to secure a wallet or keys, wherein the latch is secured to the first pocket panel.

11. An apparel item with integrated storage comprising:
an apparel item having a surface;
a first pocket panel affixed to the surface of the apparel item, wherein the first pocket panel comprises:
a plurality of interior compartments each having an opening to form a plurality of pockets, and
a seam separating adjacent pockets of the plurality of pockets,
wherein the apparel item is a shirt and the first pocket panel is affixed to an interior of the surface near a top of the shirt.

12. The apparel item of claim 11, wherein an opening of each pocket of the plurality of pockets is accessed from a neckline of the shirt.

13. The apparel item of claim 11, wherein the plurality of pockets comprises a pair of side pockets and a center pocket, wherein the pair of side pockets are affixed to the interior surface at a bottom edge of each of the pair of side pockets, wherein the center pocket is not attached along a bottom edge to form a free-hanging pocket.

14. The apparel item of claim 11, further comprising a strap used to secure a pair of glasses, wherein the strap is positioned at a top edge of the first pocket panel.

15. An apparel item with integrated storage comprising:
an apparel item having a surface;
a first pocket panel affixed to the surface of the apparel item, wherein the first pocket panel comprises:
a plurality of interior compartments each having an opening to form a plurality of pockets, and
a seam separating adjacent pockets of the plurality of pockets,
wherein the first pocket panel is attached to an exterior of the surface of the apparel item with a zipper at a top edge of the first pocket panel, thereby creating an additional pocket between the exterior surface and the first pocket panel.

* * * * *